US009532600B2

(12) United States Patent
Thorens et al.

(10) Patent No.: US 9,532,600 B2
(45) Date of Patent: Jan. 3, 2017

(54) ELECTRICALLY HEATED AEROSOL GENERATING SYSTEM HAVING IMPROVED HEATER CONTROL

(75) Inventors: Michel Thorens, Moudon (CH); Jean-Marc Flick, Pomy (CH); Olivier Yves Cochand, Dombresson (CH); Flavien Dubief, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 663 days.

(21) Appl. No.: 13/990,062

(22) PCT Filed: Dec. 2, 2011

(86) PCT No.: PCT/EP2011/071608

§ 371 (c)(1),
(2), (4) Date: Sep. 6, 2013

(87) PCT Pub. No.: WO2012/072790

PCT Pub. Date: Jun. 7, 2012

(65) Prior Publication Data

US 2013/0340750 A1 Dec. 26, 2013

(30) Foreign Application Priority Data

Dec. 3, 2010 (EP) ..... 10252049

(51) Int. Cl.

| | |
|---|---|
| ***H05B 3/00*** | (2006.01) |
| ***A61M 15/00*** | (2006.01) |
| ***A24F 47/00*** | (2006.01) |

(52) U.S. Cl.

CPC ..... *A24F 47/008* (2013.01)

(58) Field of Classification Search

None

See application file for complete search history.

(56) References Cited

U.S. PATENT DOCUMENTS

| | | | | |
|---|---|---|---|---|
| 4,947,875 | A | 8/1990 | Brooks et al. | |
| 6,040,560 | A * | 3/2000 | Fleischhauer | A24F 47/008 128/202.21 |

(Continued)

FOREIGN PATENT DOCUMENTS

| | | |
|---|---|---|
| WO | 2009132793 | 11/2009 |
| WO | 2010145805 | 12/2010 |

OTHER PUBLICATIONS

International Search Report and Written Opinion mailed Mar. 8, 2012 in International Application No. PCT/EP2011/071608.

*Primary Examiner* — Bradley Philips
*Assistant Examiner* — Eric Bryant
(74) *Attorney, Agent, or Firm* — Oblon, McClelland, Maier & Neustadt, L.L.P.

(57) ABSTRACT

In a method for controlling at least one electric heating element of an electrically heated aerosol generating system for heating an aerosol-forming substrate, the electrically heated aerosol generating system includes a sensor for detecting airflow indicative of a user taking a puff having an airflow duration, and the method includes increasing heating power for at least one heating element from zero to power p1 when the sensor detects that the airflow rate has increased to a first threshold, maintaining the heating power at a power p1 for at least some of the airflow duration, and decreasing the heating power for the at least one heating element from power p1 to zero when the sensor detects that the airflow rate has decreased to a second threshold.

12 Claims, 4 Drawing Sheets

(56) References Cited

U.S. PATENT DOCUMENTS

| | | | | |
|---|---|---|---|---|
| 2008/0092912 | A1 | 4/2008 | Robinson et al. | |
| 2009/0095311 | A1* | 4/2009 | Han | A24F 47/008 131/194 |
| 2009/0133691 | A1* | 5/2009 | Yamada | A61M 11/041 128/200.16 |
| 2009/0272379 | A1* | 11/2009 | Thorens | A24D 3/18 128/202.21 |
| 2011/0126848 | A1* | 6/2011 | Zuber | A24F 47/008 131/329 |
| 2013/0255702 | A1* | 10/2013 | Griffith, Jr. | A24F 47/008 131/328 |
| 2014/0096781 | A1* | 4/2014 | Sears | A24F 47/008 131/328 |

* cited by examiner

ELECTRICALLY HEATED AEROSOL GENERATING SYSTEM HAVING IMPROVED HEATER CONTROL

CROSS REFERENCE TO RELATED APPLICATION

This application is a national phase application based on PCT/EP2011/071608, filed Dec. 2, 2011.

The present invention relates to a method for controlling at least one electric heating element of an electrically heated aerosol generating system. The present invention further relates to an electrically heated aerosol generating system. The present invention finds particular application as a method for controlling at least one electric heating element of an electrically heated smoking system and as an electrically heated smoking system.

WO-A-2009/132793 discloses an electrically heated smoking system. A liquid is stored in a liquid storage portion, and a capillary wick has a first end which extends into the liquid storage portion for contact with the liquid therein, and a second end which extends out of the liquid storage portion. A heating element heats the second end of the capillary wick. The heating element is in the form of a spirally wound electric heating element in electrical connection with a power supply, and surrounding the second end of the capillary wick. In use, the heating element may be activated by the user to switch on the power supply. Suction on a mouthpiece by the user causes air to be drawn into the electrically heated smoking system over the capillary wick and heating element and subsequently into the mouth of the user.

It is an objective of the invention to provide an improved method of controlling the electric heating element of such an electrically heated aerosol generating system.

According to a first aspect of the invention, there is provided a method for controlling at least one electric heating element of an electrically heated aerosol generating system for heating an aerosol-forming substrate, the system having a sensor for detecting airflow indicative of a user taking a puff having an airflow duration, the method comprising the steps of: increasing the heating power for the at least one heating element from zero to a power p1 when the sensor detects that the airflow rate has increased to a first threshold; maintaining the heating power at power p1 for at least some of the airflow duration; and decreasing the heating power for the at least one heating element from power p1 to zero when the sensor detects that the airflow rate has decreased to a second threshold.

The at least one electric heating element is arranged to heat the aerosol-forming substrate to form the aerosol. The electrically heated aerosol generating system may include the aerosol-forming substrate or may be adapted to receive the aerosol-forming substrate. As known to those skilled in the art, an aerosol is a suspension of solid particles or liquid droplets in a gas, such as air. By controlling the heating power supplied to the at least one heating element, energy usage can be optimised. The heating power may be tailored to the particular puff profile so that the desired aerosol properties, for example aerosol concentration or particle size, can be achieved. Overheating or underheating can be avoided, particularly towards the start or end of the puff. The decrease of power towards the end of the puff affects the cooling of the heating element and hence the temperature of the heating element and its vicinity. This, in turn, affects how much condensation is able to form in the system, which may affect liquid leakage.

Preferably, the electrically heated aerosol generating system comprises a power supply for supplying power to the at least one electric heating element. Preferably, the electrically heated aerosol generating system comprises electric circuitry for controlling supply of power from the power supply to the at least one electric heating element. Preferably, the electric circuitry comprises the sensor.

Preferably, the electric circuitry is arranged to perform the method steps of the first aspect of the invention. The electric circuitry may be hardwired to perform the method steps of the first aspect of the invention. More preferably, however, the electric circuitry is programmable to perform the method steps of the first aspect of the invention.

The sensor may be any sensor which can detect airflow indicative of a user taking a puff. The sensor may be an electro-mechanical device. Alternatively, the sensor may be any of: a mechanical device, an optical device, an opto-mechanical device, a micro electro mechanical systems (MEMS) based sensor and an acoustic sensor.

Typically, the airflow rate (which may also be known as the puff-flow rate), during the airflow duration (which may be the same as the puff duration), increases from zero to the first threshold to a maximum, and then decreases from the maximum to the second threshold and then to zero. The airflow rate may form a Gaussian or normal distribution (also known as a bell shaped curve). More usually, however, the airflow rate may form a non-perfect Gaussian distribution. The airflow duration may be defined in a number of ways. For example, the airflow duration may be defined as the time period during which the airflow rate is non-zero. Alternatively, the airflow duration may be defined as the time period during which the airflow rate is greater than a pre-defined level. Preferably, the power p1 is pre-defined. The power p1 may depend on a number of factors including, but not limited to, the form of electric heating element, the type of aerosol forming substrate, the amount of aerosol desired to be formed and the particle size required for the aerosol.

In one embodiment, the first airflow rate threshold is equal to the second airflow rate threshold. This embodiment is advantageous, because the operation of the method is relatively simple.

In another embodiment, the first airflow rate threshold is smaller than the second airflow rate threshold. This embodiment is advantageous because it may contribute to avoiding overheating towards the end of the puff which, in turn, affects condensation formation. Because the second airflow rate threshold, at which the heating power is decreased, is greater than the first airflow rate threshold, at which the heating power is increased, the heating power supplied to the at least one heating element is decreased earlier in the puff. This avoids overheating towards the end of the airflow duration.

The step of increasing the heating power for the at least one heating element from zero to power p1 may comprise increasing the heating power from zero to power p1 substantially instantly. That is to say, the power may be increased from zero to power p1 over a time period which is substantially equal to zero. On a plot of heating power on the vertical axis versus time on the horizontal axis, this would be represented by a vertical, or substantially vertical, line from zero power to power p1.

Alternatively, the step of increasing the heating power for the at least one heating element from zero to power p1 may comprise increasing the heating power from zero to power p1 over a time period not equal to zero. That is to say, the power may be increased from zero to power p1 gradually over a selected time period. The longer the selected time period, the more gradual the power increase. On a plot of heating power on the vertical axis versus time on the horizontal axis, this would be represented by a slope with a positive gradient from zero power to power p1. The gradient of the slope may be constant or non-constant.

The step of decreasing the heating power for the at least one heating element from power p1 to zero may comprise decreasing the heating power from power p1 to zero substantially instantly. That is to say, the power may be decreased from power p1 to zero over a time period which is substantially equal to zero. On a plot of heating power on the vertical axis versus time on the horizontal axis, this would be represented by a vertical, or substantially vertical, line from power p1 to zero power.

Alternatively, the step of decreasing the heating power for the at least one heating element from power p1 to zero may comprise decreasing the heating power from power p1 to zero gradually. That is to say, the power may be decreased over a time period not equal to zero. That is to say, the power may be decreased from power p1 to zero gradually over a selected time period. The longer the selected time period, the more gradual the power decrease. On a plot of heating power on the vertical axis versus time on the horizontal axis, this would be represented by a slope with a negative gradient from power p1 to power zero. The gradient of the slope may be constant or non-constant.

In one embodiment, the method further comprises, after the step of increasing the heating power for the at least one heating element from zero to power p1, the step of: increasing the heating power for the at least one heating element from power p1 to power p2, greater than power p1.

That is to say, at the beginning of the airflow duration, the heating power is p2, greater than p1. This provides a burst of electric power at the start of the puff. Preferably, after the initial burst of electric power, having a maximum power p2, the power decreases to power p1 and, for the remainder of the airflow duration, the heating power is maintained at power p1. Such an overheat towards the start of the airflow duration results in the aerosol generation beginning earlier. This may provide better reactivity for the user. This may also decrease aerosol particle size or aerosol concentration at the start of the puff. Preferably, the power p2 is pre-defined. The power p2 may depend on a number of factors including, but not limited to, the form of electric heating element, the type of aerosol forming substrate, the amount of aerosol desired to be formed and the particle size required for the aerosol.

The step of maintaining the heating power at a power p1 for at least some of the airflow duration may comprise supplying pulses of electric current to the at least one heating element at a first frequency f1 and a first duty cycle. The first frequency f1, the first duty cycle, or both the first frequency f1 and the first duty cycle may be selected appropriately so as to maintain the heating power at the desired level. The current pulses may have any suitable maximum current.

The step of decreasing the heating power from power p1 to zero gradually may comprise supplying pulses of electric current to the at least one heating element at a second frequency f2 and a second duty cycle. The second frequency f2, the second duty cycle, or both the second frequency f2 and the second duty cycle may be selected appropriately so as to decrease the heating power appropriately. The second frequency f2 may be lower than the first frequency f1. Alternatively, the first frequency f1 and the second frequency f2 may be equal. The second duty cycle may be lower than the first duty cycle. Alternatively, the first duty cycle and the second duty cycle may be equal.

The step of increasing the heating power for the at least one heating element from power p1 to power p2, greater than power p1 may comprise supplying pulses of electric current to the at least one heating element at a third frequency f3 and a third duty cycle. The third frequency f3, the third duty cycle, or both the third frequency f3 and the third duty cycle may be selected appropriately so as to increase the heating power to power p2. The third frequency f3 may be higher than both the first frequency f1 and the second frequency f2. The third frequency may be equal to one or both of the first frequency f1 and the second frequency f2. The third duty cycle may be lower than the second duty cycle. The third duty cycle may be equal to one or both of the first duty cycle and the second duty cycle.

According to a second aspect of the invention, there is provided an electrically heated aerosol generating system for heating an aerosol-forming substrate, the system comprising: at least one electric heating element for heating the aerosol-forming substrate to form the aerosol; a power supply for supplying power to the at least one electric heating element; and electric circuitry for controlling supply of power from the power supply to the at least one electric heating element, the electric circuitry including a sensor for detecting airflow indicative of a user taking a puff having an airflow duration; wherein the electric circuitry is arranged to increase the heating power for the at least one heating element from zero to a power p1 when the sensor detects that the airflow rate has increased to a first threshold; to maintain the heating power at power p1 for at least some of the airflow duration; and to decrease the heating power for the at least one heating element from power p1 to zero when the sensor detects that the airflow rate has decreased to a second threshold.

In one embodiment, the aerosol-forming substrate is a liquid substrate and the electrically heated aerosol generating system further comprises a capillary wick for conveying the liquid substrate to the at least one electric heating element. As will be discussed further below, the heating element in combination with a capillary wick may provide a fast response and therefore improved control of the heating profile.

According to a third aspect of the invention, there is provided electric circuitry for an electrically heated aerosol generating system, the electric circuitry being arranged to perform the method of the first aspect of the invention.

Preferably, the electric circuitry is programmable to perform the method of the first aspect of the invention. Alternatively, the electric circuitry may be hardwired to perform the method of the first aspect of the invention.

According to a fourth aspect of the invention, there is provided a computer program which, when run on programmable electric circuitry for an electrically heated aerosol generating system, causes the programmable electric circuitry to perform the method of the first aspect of the invention.

According a fifth aspect of the invention, there is provided a-computer readable storage medium having stored thereon a computer program according to the fourth aspect of the invention.

The at least one electric heating element may comprise a single heating element. Alternatively, the at least one electric heating element may comprise more than one heating element for example two, or three, or four, or five, or six or more heating elements. The heating element or heating elements may be arranged appropriately so as to most effectively heat the aerosol-forming substrate.

The at least one electric heating element preferably comprises an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, Constantan, nickel-, cobalt-, chromium-, aluminium-titanium- zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminium based alloys and iron-manganese-aluminium based alloys. Timetal® is a registered trade mark of Titanium Metals Corporation, 1999 Broadway Suite 4300, Denver Colo. In composite materials, the electrically resistive material may optionally be embedded in, encapsulated or coated with an insulating material or vice-versa, depending on the kinetics of energy transfer and the external physicochemical properties required. The heating element may comprise a metallic etched foil insulated between two layers of an inert material. In that case, the inert material may comprise Kapton®, all-polyimide or mica foil. Kapton® is a registered trade mark of E.I. du Pont de Nemours and Company, 1007 Market Street, Wilmington, Del. 19898, United States of America.

Alternatively, the at least one electric heating element may comprise an infra-red heating element, a photonic source, or an inductive heating element.

The at least one electric heating element may take any suitable form. For example, the at least one electric heating element may take the form of a heating blade. Alternatively, the at least one electric heating element may take the form of a casing or substrate having different electro-conductive portions, or an electrically resistive metallic tube. If the aerosol-forming substrate is a liquid provided within a container, the container may incorporate a disposable heating element. Alternatively, one or more heating needles or rods that run through the centre of the aerosol-forming substrate may also be suitable. Alternatively, the at least one electric heating element may be a disk (end) heater or a combination of a disk heater with heating needles or rods. Alternatively, the at least one electric heating element may comprise a flexible sheet of material arranged to surround or partially surround the aerosol-forming substrate. Other alternatives include a heating wire or filament, for example a Ni—Cr, platinum, tungsten or alloy wire, or a heating plate. Optionally, the heating element may be deposited in or on a rigid carrier material.

The at least one electric heating element may comprise a heat sink, or heat reservoir comprising a material capable of absorbing and storing heat and subsequently releasing the heat over time to the aerosol-forming substrate. The heat sink may be formed of any suitable material, such as a suitable metal or ceramic material. Preferably, the material has a high heat capacity (sensible heat storage material), or is a material capable of absorbing and subsequently releasing heat via a reversible process, such as a high temperature phase change. Suitable sensible heat storage materials include silica gel, alumina, carbon, glass mat, glass fibre, minerals, a metal or alloy such as aluminium, silver or lead, and a cellulose material such as paper. Other suitable materials which release heat via a reversible phase change include paraffin, sodium acetate, naphthalene, wax, polyethylene oxide, a metal, metal salt, a mixture of eutectic salts or an alloy.

The heat sink or heat reservoir may be arranged such that it is directly in contact with the aerosol-forming substrate and can transfer the stored heat directly to the substrate. Alternatively, the heat stored in the heat sink or heat reservoir may be transferred to the aerosol-forming substrate by means of a heat conductor, such as a metallic tube.

The at least one heating element may heat the aerosol-forming substrate by means of conduction. The heating element may be at least partially in contact with the substrate, or the carrier on which the substrate is deposited. Alternatively, the heat from the heating element may be conducted to the substrate by means of a heat conductive element.

Alternatively, the at least one heating element may transfer heat to the incoming ambient air that is drawn through the electrically heated aerosol generating system during use, which in turn heats the aerosol-forming substrate by convection. The ambient air may be heated before passing through the aerosol-forming substrate. Alternatively, if the aerosol-forming substrate is a liquid substrate, the ambient air may be first drawn through the substrate and then heated.

The aerosol-forming substrate may be a solid aerosol-forming substrate. The aerosol-forming substrate preferably comprises a tobacco-containing material containing volatile tobacco flavour compounds which are released from the substrate upon heating. The aerosol-forming substrate may comprise a non-tobacco material. The aerosol-forming substrate may comprise tobacco-containing material and non-tobacco containing material. Preferably, the aerosol-forming substrate further comprises an aerosol former. Examples of suitable aerosol formers are glycerine and propylene glycol.

Alternatively, the aerosol-forming substrate may be a liquid aerosol-forming substrate. In one embodiment, the electrically heated aerosol generating system further comprises a liquid storage portion. Preferably, the liquid aerosol-forming substrate is stored in the liquid storage portion. In one embodiment, the electrically heated aerosol generating system further comprises a capillary wick in communication with the liquid storage portion. It is also possible for a capillary wick for holding liquid to be provided without a liquid storage portion. In that embodiment, the capillary wick may be preloaded with liquid.

Preferably, the capillary wick is arranged to be in contact with liquid in the liquid storage portion. In that case, in use, liquid is transferred from the liquid storage portion towards the at least one electric heating element by capillary action in the capillary wick. In one embodiment, the capillary wick has a first end and a second end, the first end extending into the liquid storage portion for contact with liquid therein and the at least one electric heating element being arranged to heat liquid in the second end. When the heating element is activated, the liquid at the second end of the capillary wick is vaporized by the heater to form the supersaturated vapour. The supersaturated vapour is mixed with and carried in the airflow. During the flow, the vapour condenses to form the aerosol and the aerosol is carried towards the mouth of a user. The heating element in combination with a capillary wick may provide a fast response, because that arrangement may provide a high surface area of liquid to the heating element. Control of the heating element according to the invention may therefore depend on the structure of the capillary wick arrangement.

The liquid substrate may be absorbed into a porous carrier material, which may be made from any suitable absorbent plug or body, for example, a foamed metal or plastics material, polypropylene, terylene, nylon fibres or ceramic. The liquid substrate may be retained in the porous carrier material prior to use of the electrically heated aerosol generating system or alternatively, the liquid substrate material may be released into the porous carrier material during, or immediately prior to use. For example, the liquid substrate may be provided in a capsule. The shell of the capsule preferably melts upon heating and releases the liquid substrate into the porous carrier material. The capsule may optionally contain a solid in combination with the liquid.

If the aerosol-forming substrate is a liquid substrate, the liquid has physical properties, for example a boiling point suitable for use in the aerosol generating system: if the boiling point is too high, the at least one electric heating element will not be able to vaporize liquid in the capillary wick, but, if the boiling point is too low, the liquid may vaporize even without the at least one electric heating element being activated. Control of the at least one electric heating element may depend upon the physical properties of the liquid substrate. The liquid preferably comprises a tobacco-containing material comprising volatile tobacco flavour compounds which are released from the liquid upon heating. Alternatively, or in addition, the liquid may comprise a non-tobacco material. The liquid may include water, solvents, ethanol, plant extracts and natural or artificial flavours. Preferably, the liquid further comprises an aerosol former. Examples of suitable aerosol formers are glycerine and propylene glycol.

An advantage of providing a liquid storage portion is that a high level of hygiene can be maintained. Using a capillary wick extending between the liquid and the electric heating element, allows the structure of the system to be relatively simple. The liquid has physical properties, including viscosity and surface tension, which allow the liquid to be transported through the capillary wick by capillary action. The liquid storage portion is preferably a container. The liquid storage portion may not be refillable. Thus, when the liquid in the liquid storage portion has been used up, the aerosol generating system is replaced. Alternatively, the liquid storage portion may be refillable. In that case, the aerosol generating system may be replaced after a certain number of refills of the liquid storage portion. Preferably, the liquid storage portion is arranged to hold liquid for a pre-determined number of puffs.

The capillary wick may have a fibrous or spongy structure. The capillary wick preferably comprises a bundle of capillaries. For example, the capillary wick may comprise a plurality of fibres or threads, or other fine bore tubes. The fibres or threads may be generally aligned in the longitudinal direction of the aerosol generating system. Alternatively, the capillary wick may comprise sponge-like or foam-like material formed into a rod shape. The rod shape may extend along the longitudinal direction of the aerosol generating system. The structure of the wick forms a plurality of small bores or tubes, through which the liquid can be transported to the electric heating element, by capillary action. The capillary wick may comprise any suitable material or combination of materials. Examples of suitable materials are ceramic- or graphite-based materials in the form of fibres or sintered powders. The capillary wick may have any suitable capillarity and porosity so as to be used with different liquid physical properties such as density, viscosity, surface tension and vapour pressure. The capillary properties of the wick, combined with the properties of the liquid, ensure that the wick is always wet in the heating area. If the wick is dry, there may be overheating, which can lead to thermal degradation of liquid.

The aerosol-forming substrate may alternatively be any other sort of substrate, for example, a gas substrate, or any combination of the various types of substrate. During operation, the substrate may be completely contained within the electrically heated aerosol generating system. In that case, a user may puff on a mouthpiece of the electrically heated aerosol generating system. Alternatively, during operation, the substrate may be partially contained within the electrically heated aerosol generating system. In that case, the substrate may form part of a separate article and the user may puff directly on the separate article.

Preferably, the electrically heated aerosol generating system is an electrically heated smoking system.

The electrically heated aerosol generating system may comprise an aerosol-forming chamber in which aerosol forms from a super saturated vapour, which aerosol is then carried into the mouth of the user. An air inlet, air outlet and the chamber are preferably arranged so as to define an airflow route from the air inlet to the air outlet via the aerosol-forming chamber, so as to convey the aerosol to the air outlet and into the mouth of a user. Condensation may form on the walls of the aerosol-forming chamber. The amount of condensation may depend on the heating profile, particularly towards the end of the puff.

Preferably, the aerosol generating system comprises a housing. Preferably, the housing is elongate. The structure of the housing, including the surface area available for condensation to form, will affect the aerosol properties and whether there is liquid leakage from the system. The housing may comprise a shell and a mouthpiece. In that case, all the components may be contained in either the shell or the mouthpiece. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle. The material of the housing may affect the amount of condensation forming on the housing which will, in turn, affect liquid leakage from the system.

Preferably, the aerosol generating system is portable. The aerosol generating system may be a smoking system and may have a size comparable to a conventional cigar or cigarette. The smoking system may have a total length between approximately 30 mm and approximately 150 mm. The smoking system may have an external diameter between approximately 5 mm and approximately 30 mm.

Features described in relation to one aspect of the invention may be applicable to another aspect of the invention.

The method and electrically heated aerosol generating system according to the present invention provide a number of advantages. The heating profile may be tailored to the puff profile, thereby providing an improved experience for the user. The heating profile may also produce desired aerosol properties, for example aerosol concentration or aerosol particle size. The heating profile may also affect the formation of aerosol condensate which, in turn, may affect liquid leakage from the system. Power usage may be optimised, so as to provide a good heating profile, without unnecessary power wastage.

The invention will be further described, by way of example only, with reference to the accompanying drawings, in which.

Figure 1:
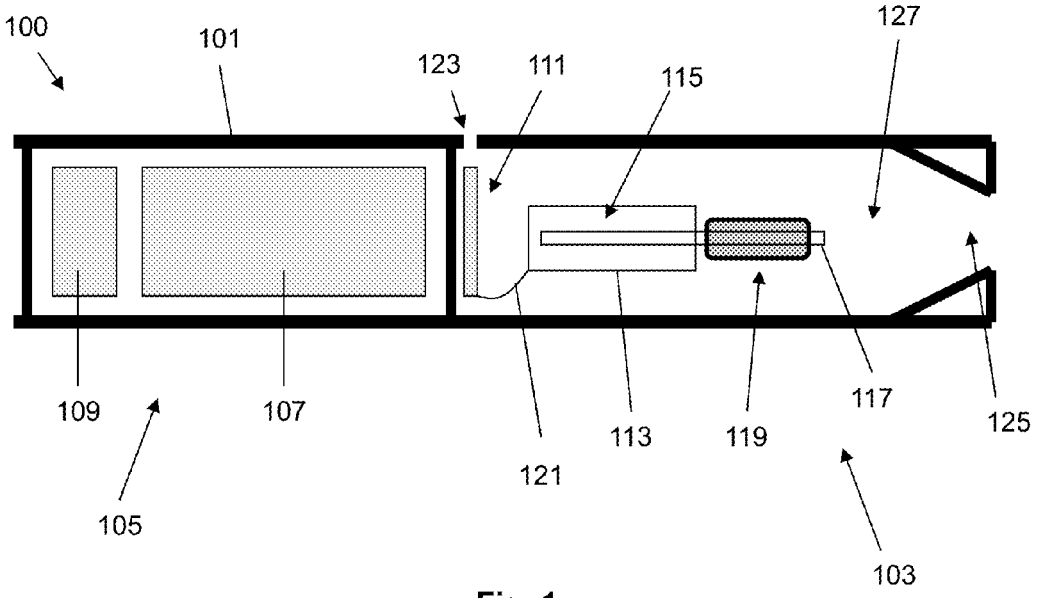
FIG. 1 shows one example of an electrically heated aerosol generating system.

FIG. 1 shows one example of an electrically heated aerosol generating system. In FIG. 1, the system is a smoking system having a liquid storage portion. The smoking system 100 of FIG. 1 comprises a housing 101 having a first end which is the mouthpiece end 103 and a second end which is the body end 105. In the body end, there is provided an electric power supply in the form of battery 107 and electric circuitry in the form of hardware 109 and a puff detection system 111. In the mouthpiece end, there is provided a liquid storage portion in the form of cartridge 113 containing liquid 115, a capillary wick 117 and a heater 119 comprising at least one heating element. Note that the heater is only shown schematically in FIG. 1. One end of the capillary wick 117 extends into the cartridge 113 and the other end of the capillary wick 117 is surrounded by the heater 119. The heater is connected to the electric circuitry via connections 121. The housing 101 also includes an air inlet 123, an air outlet 125 at the mouthpiece end and an aerosol-forming chamber 127.

In use, operation is as follows. Liquid 115 is transferred or conveyed by capillary action from the cartridge 113 from the end of the wick 117 which extends into the cartridge to the other end of the wick 117 which is surrounded by the heater 119. When a user draws on the device at the air outlet 125, ambient air is drawn through air inlet 123. In the arrangement shown in FIG. 1, the puff detection system 111 senses the puff and activates the heater 119. The battery 107 supplies energy to the heater 119 to heat the end of the wick 117 surrounded by the heater. The liquid in that end of the wick 117 is vaporized by the heater 119 to create a supersaturated vapour. At the same time, the liquid being vaporized is replaced by further liquid moving along the wick 117 by capillary action. (This is sometimes referred to as "pumping action".) The supersaturated vapour created is mixed with and carried in the airflow from the air inlet 123. In the aerosol-forming chamber 127, the vapour condenses to form an inhalable aerosol, which is carried towards the outlet 125 and into the mouth of the user.

The capillary wick can be made from a variety of porous or capillary materials and preferably has a known, predefined capillarity. Examples include ceramic- or graphite-based materials in the form of fibres or sintered powders. Wicks of different porosities can be used to accommodate different liquid physical properties such as density, viscosity, surface tension and vapour pressure. The wick must be suitable so that the required amount of liquid can be delivered to the heating element. The wick and heating element must be suitable so that the required amount of aerosol can be conveyed to the user.

In the embodiment shown in FIG. 1, the hardware 109 and the puff detection system 111 are preferably programmable. The hardware 109 and puff detection system 111 can be used to manage the device operation. This assists with control of the particle size in the aerosol.

FIG. 1 shows one example of an electrically heated aerosol generating system which may be used with the present invention. Many other examples are usable with the invention, however. The electrically heated aerosol generating system simply needs to include or receive an aerosol forming substrate which can be heated by at least one electric heating element, powered by a power supply under the control of electric circuitry. For example, the system need not be a smoking system. For example, the aerosol forming substrate may be a solid substrate, rather than a liquid substrate. Alternatively, the aerosol forming substrate may be another form of substrate such as a gas substrate. The heating element may take any appropriate form. The overall shape and size of the housing could be altered and the housing could comprise a separable shell and mouthpiece. Other variations are, of course, possible.

As already mentioned, preferably, the electric circuitry, comprising hardware 109 and the puff detection system 111, is programmable in order to control the supply of power to the heating element. This, in turn, affects the heating profile which will affect the properties of the aerosol. The term "heating profile" refers to a graphic representation of the power supplied to the heating element (or another similar measure, for example, the heat generated by the heating element) over the time taken for a puff. Alternatively, the hardware 109 and the puff detection system 111 may be hardwired to control the supply of power to the heating element. Again, this will affect the heating profile which will affect the particle size in the aerosol. Various methods of controlling the power supplied to the heating element are illustrated in FIGS. 2 to 7.

Figure 2:
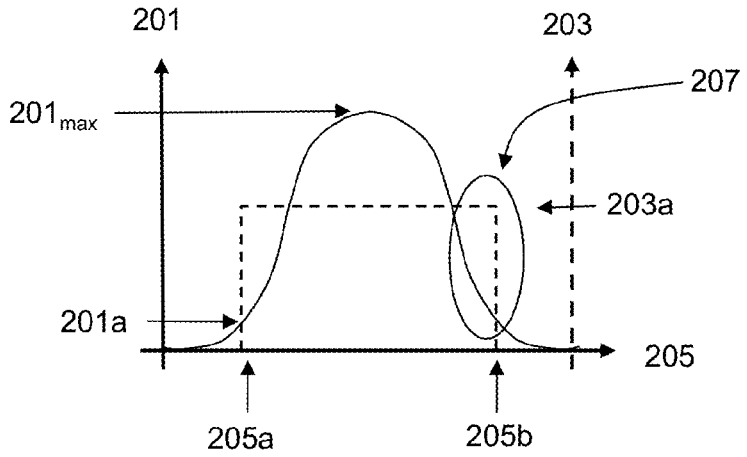
FIG. 2 shows a first embodiment of a method for controlling the heating power to a heating element of an electrically heated aerosol generating system.

FIG. 2 shows a first embodiment of a method for controlling the heating power to a heating element of an electrically heated aerosol generating system, according to the invention.

FIG. 2 is a plot showing airflow rate 201 and heating power 203 on the vertical axis, and time 205 on the horizontal axis. Airflow rate 201 is shown by a solid line and heating power 203 is shown by a dotted line. Airflow rate is measured in volume per unit of time, typically cubic centimeters per second. The airflow rate is sensed by a puff detection system, such as puff detection system 111 in FIG. 1. The heating power, measured in Watts, is the power provided to the heating element from the power supply, under control of the electric circuitry such as hardware 109 in FIG. 1. FIG. 2 shows a single puff taken by a user on an electrically heated aerosol generating system, such as that shown in FIG. 1.

As can be seen in FIG. 2, in this embodiment, the airflow rate for the puff is illustrated as taking the shape of a normal or Gaussian distribution. The airflow rate begins at zero, increases gradually to a maximum $\mathbf{201}_{max}$, then decreases back to zero. However, the airflow rate will typically not have an exact Gaussian distribution. In all cases, however, the airflow rate across a puff will increase from zero to a maximum, the decrease from the maximum to zero. The area under the airflow rate curve is the total air volume for that puff.

When the puff detection system senses that the airflow rate 201 has increased to a threshold 201*a*, at a time 205*a*, the electric circuitry controls the power to switch on the heating element and increase the heating power 203 directly from zero to power 203*a*. When the puff detection system senses that the airflow rate 201 has decreased back to threshold 201*a*, at a time 205*b*, the electric circuitry controls the power to switch off the heating element and decrease the heating power 203 directly from power 203*a* to zero. Between time 205*a* and time 205*b*, whilst the puff detection system detects that the airflow rate remains greater than threshold 201*a*, the heating power to the heating element is maintained at power 203*a*. Thus, the heating period is time 205*b*-205*a*.

In the embodiment of FIG. 2, the airflow rate threshold for switching on the heating element is the same as the airflow rate threshold for switching off the heating element. The advantage of the FIG. 2 arrangement is the simplicity of design. However, with this arrangement there is a risk of overheating towards the end of the puff. This is shown in FIG. 2 at circled area 207.

Figure 3:
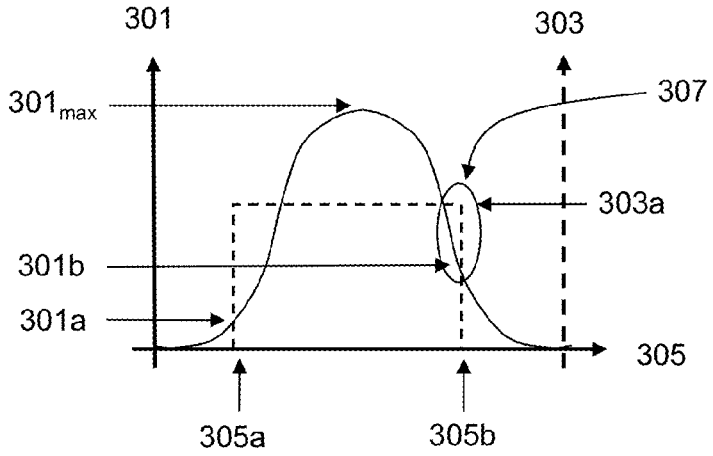
FIG. 3 shows a second embodiment of a method for controlling the heating power to a heating element of an electrically heated aerosol generating system.

FIG. 3 shows a second embodiment of a method for controlling the heating power to a heating element of an electrically heated aerosol generating system, according to the invention. The FIG. 3 arrangement may, in some circumstances, provide an improvement over the arrangement shown in FIG. 2.

FIG. 3 is a plot showing airflow rate 301 and heating power 303 on the vertical axis, and time 305 on the horizontal axis. Airflow rate 301 is shown by a solid line and heating power 303 is shown by a dotted line. Again, airflow rate is measured in volume per unit of time, typically cubic centimeters per second. The airflow rate is sensed by a puff detection system, such as puff detection system 111 in FIG. 1. The heating power, measured in Watts, is the power provided to the heating element from the power supply, under control of the electric circuitry such as hardware 109 in FIG. 1. FIG. 3 shows a single puff taken by a user on an electrically heated aerosol generating system, such as that shown in FIG. 1.

As in FIG. 2, the airflow rate for the puff is illustrated as taking the shape of a Gaussian distribution, although this need not be the case. Indeed, in most cases, the airflow rate curve will not form an exact Gaussian distribution. The airflow rate begins at zero, increases gradually to a maximum $\mathbf{301}_{max}$, then decreases back to zero. The area under the airflow rate curve is the total air volume for that puff.

When the puff detection system senses that the airflow rate 301 has increased to a threshold 301*a*, at a time 305*a*, the electric circuitry controls the power to switch on the heating element and increase the heating power 303 directly from zero to power 303*a*. When the puff detection system senses that the airflow rate 301 has decreased to a threshold 301*b*, at a time 305*b*, the electric circuitry controls the power to switch off the heating element and decrease the heating power 303 directly from power 303*a* to zero. Between time 305*a* and time 305*b*, the heating power to the heating element is maintained at power 303*a*. Thus, the heating period is time 305*b*-305*a*.

In the embodiment of FIG. 3, the airflow rate threshold 301*b* for switching off the heating element is greater than the airflow rate threshold 301*a* for switching on the heating element. This means that the heating element is switched off earlier in the puff than in the FIG. 2 arrangement. This avoids possible overheating towards the end of the puff. Note the reduced area of circled area 307 in FIG. 3 compared with circled area 207 in FIG. 2. Switching off the heating element earlier in the puff means that there is a greater airflow as the heating element is cooling. This may prevent too much condensation forming on the inner surface of the housing. This may, in turn, reduce the possibility of liquid leakage.

Figure 4:
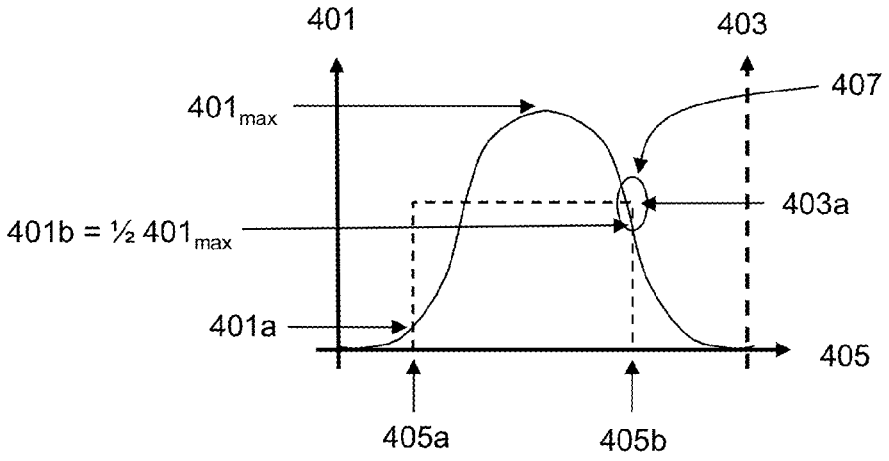
FIG. 4 shows a third embodiment of a method for controlling the heating power to a heating element of an electrically heated aerosol generating system.

FIG. 4 shows a third embodiment of a method for controlling the heating power to a heating element of an electrically heated aerosol generating system, according to the invention, which is similar to the embodiment shown in FIG. 3. The arrangement of FIG. 4 may also, in some circumstances, provide an improvement over the arrangement shown in FIG. 2.

FIG. 4 is a plot showing airflow rate 401 and heating power 403 on the vertical axis, and time 405 on the horizontal axis. Airflow rate 401 is shown by a solid line and heating power 403 is shown by a dotted line. Again, airflow rate is measured in volume per unit of time, typically cubic centimeters per second. The airflow rate is sensed by a puff detection system, such as puff detection system 111 in FIG. 1. The heating power, measured in Watts, is the power provided to the heating element from the power supply, under control of the electric circuitry such as hardware 109 in FIG. 1. FIG. 4 shows a single puff taken by a user on an electrically heated aerosol generating system, such as that shown in FIG. 1.

As in FIGS. 2 and 3, the airflow rate for the puff takes the shape of a Gaussian distribution, although this need not be the case. The airflow rate begins at zero, increases gradually to a maximum $\mathbf{401}_{max}$, then decreases back to zero. The area under the airflow rate curve is the total air volume for that puff.

When the puff detection system senses that the airflow rate 401 has increased to a threshold 401*a*, at a time 405*a*, the electric circuitry controls the power to switch on the heating element and increase the heating power 403 directly from zero to power 403*a*. When the puff detection system senses that the airflow rate 401 has decreased to a threshold 401*b*, at a time 405*b*, the electric circuitry controls the power to switch off the heating element and decrease the heating power 403 directly from power 403*a* to zero. The difference between FIGS. 3 and 4 is that, in FIG. 4, the threshold 401*b* for switching off the heating element is related to the maximum airflow rate $\mathbf{401}_{max}$. In this case, the airflow rate threshold 401*b* is ½ the maximum airflow rate $\mathbf{401}_{max}$, although the airflow rate threshold 401*b* could have any appropriate relationship to the maximum airflow rate $\mathbf{401}_{max}$. The relationship may depend on the shape of the airflow rate curve. Between time 405*a* and time 405*b*, the heating power to the heating element is maintained at power 403*a*. Thus, the heating period is time 405*b*-405*a*.

In the embodiment of FIG. 4, because the airflow rate threshold for switching off the heating element is related to the maximum airflow rate, the airflow rate threshold for switching off the heating element can be more appropriate to the puff profile. By setting the relationship between the threshold and the maximum airflow rate appropriately, the heat can be maintained for an appropriate heating period, whilst avoiding overheating towards the end of the puff. Note the reduced area of circled area 407 in FIG. 4 compared with circled area 207 in FIG. 2, and even circled area 307 in FIG. 3. Switching off the heating element earlier in the puff means that there is a greater airflow as the heating element is cooling. This may prevent too much condensation forming on the inner surface of the housing. This may, in turn, reduce the possibility of liquid leakage.

Figure 5:
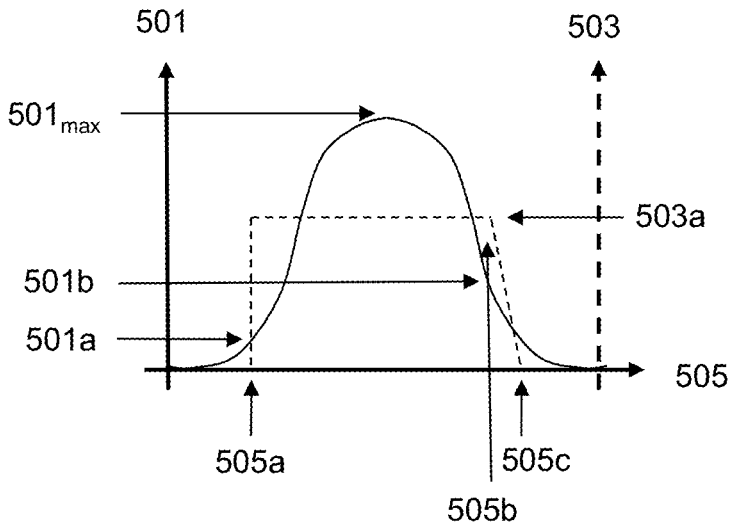
FIG. 5 shows a fourth embodiment of a method for controlling the heating power to a heating element of an electrically heated aerosol generating system.

FIG. 5 shows a fourth embodiment of a method for controlling the heating power to a heating element of an electrically heated aerosol generating system, according to the invention, which is similar to the embodiments shown in FIGS. 3 and 4. The arrangement of FIG. 5 may also, in some circumstances, provide an improvement over the arrangement shown in FIG. 2.

FIG. 5 is a plot showing airflow rate 501 and heating power 503 on the vertical axis, and time 505 on the horizontal axis. Airflow rate 501 is shown by a solid line and heating power 503 is shown by a dotted line. Again, airflow rate is measured in volume per unit of time, typically cubic centimeters per second. The airflow rate is sensed by a puff detection system, such as puff detection system 111 in FIG. 1. The heating power, measured in Watts, is the power provided to the heating element from the power supply, under control of the electric circuitry such as hardware 109 in FIG. 1. FIG. 5 shows a single puff taken by a user on an electrically heated aerosol generating system, such as that shown in FIG. 1.

As in FIGS. 2, 3 and 4, the airflow rate for the puff is illustrated as taking the shape of a Gaussian or normal distribution. However, this need not be the case. The airflow rate begins at zero, increases gradually to a maximum $\mathbf{501}_{max}$, then decreases back to zero. The area under the airflow rate curve is the total air volume for that puff.

When the puff detection system senses that the airflow rate 501 has increased to a threshold 501*a*, at a time 505*a*, the electric circuitry controls the power to switch on the heating element and increase the heating power 501 directly from zero to power 503*a*. When the puff detection system senses that the airflow rate 501 has decreased to a threshold 501*b*, at a time 505*b*, the electric circuitry controls the power to begin decreasing from power 503*a*. Unlike in FIGS. 2, 3 and 4, the electric circuitry decreases the heating power to the heating element gradually, beginning at time 505*b*, finally reaching zero power at time 505*c*. Therefore, between time 505*a* and time 505*b*, the heating power to the heating element is maintained at power 503*a*. At time 505*b*, the heating power to the heating element is decreased gradually over time until, at time 505*c*, the heating power supplied to the heating element is zero. Thus, the total heating period is time 505*c*-505*a*, with the power decreasing between time 505*b* and 505*c*. The heating power may be decreased at a constant rate as shown by the straight line in FIG. 5. Alternatively, the heating power may be decreased at a non-constant rate. As already discussed, it may be advantageous to switch off the heating element earlier in the puff to reduce the time in which the heating element is heating, but the airflow is reduced. Thus, the slope of the heating power decrease may be tailored to match the slope of the airflow profile as closely as possible, thereby minimising overheating. The heating power may be decreased at a constant rate, and the slope may be approximated to the curve of the airflow profile. Alternatively, the heating power may be decreased at a non-constant rate and the rate of decrease may be matched as closely as possible to the curve of the airflow profile. These approaches may reduce the amount of condensation that forms, and this may reduce liquid leakage.

In the embodiment of FIG. 5, because the power supplied to the heating element is reduced gradually, rather than reduced to zero immediately, the heating profile can be most appropriate to the airflow profile, while reducing power usage. The decrease of power can be arranged to follow or match the slope of the airflow profile as it decreases, thereby providing a very appropriate heating profile for the puff.

Figure 6:
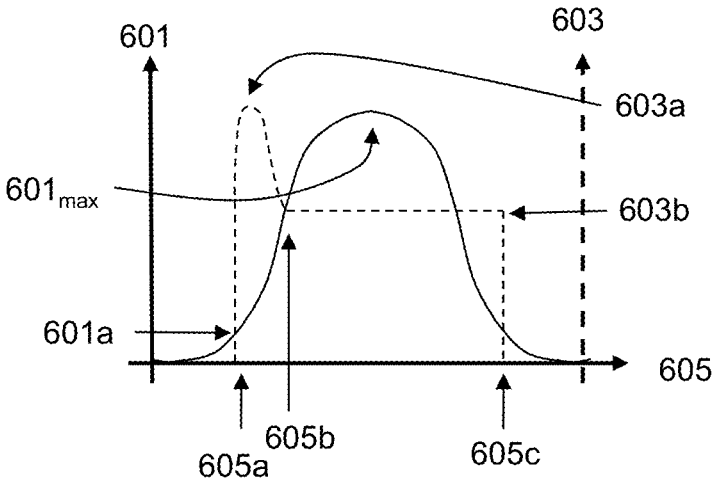
FIG. 6 shows a fifth embodiment of a method for controlling the heating power to a heating element of an electrically heated aerosol generating system.

FIG. 6 shows a fifth embodiment of a method for controlling the heating power to a heating element of an electrically heated aerosol generating system, according to the invention.

FIG. 6 is a plot showing airflow rate 601 and heating power 603 on the vertical axis, and time 605 on the horizontal axis. Airflow rate 601 is shown by a solid line and heating power 603 is shown by a dotted line. Again, airflow rate is measured in volume per unit of time, typically cubic centimeters per second. The airflow rate is sensed by a puff detection system, such as puff detection system 111 in FIG. 1. The heating power, measured in Watts, is the power provided to the heating element from the power supply, under control of the electric circuitry such as hardware 109 in FIG. 1. FIG. 6 shows a single puff taken by a user on an electrically heated aerosol generating system, such as that shown in FIG. 1.

As in FIGS. 2, 3, 4 and 5, the airflow rate for the puff is illustrated as taking the shape of a Gaussian or normal distribution. However, this need not be the case. The airflow rate begins at zero, increases gradually to a maximum $\mathbf{601}_{max}$, then decreases back to zero. The area under the airflow rate curve is the total air volume for that puff.

When the puff detection system senses that the airflow rate 601 has increased to a threshold 601*a*, at a time 605*a*, the electric circuitry controls the power to switch on the heating element and increase the heating power 603. In the arrangement of FIG. 6, the heating power is increased at the start of the puff, at time 605*a*, to a power 603*a*. Then, at a subsequent time 605*b*, the heating power has decreased to power 603*b* having a lower value than power 603*a*. The timer period between time 605*a* and time 605*b* will depend on the structure of the heating element and hence how quickly the heating element will heat up in response to power input. Then, the heating power is maintained at power level 603*b*. When the puff detection system senses that the airflow rate 601 has decreased to threshold 601*a*, at a time 605*c*, the electric circuitry controls the power to switch off the heating element and decrease the heating power from power 603*b* to zero. Thus, the heating period is time 605*c*-605*a*, with the initial power between times 605*a* and 605*b* being 603*a* and the subsequent power for the majority of the airflow duration, between time 605*b* and time 605*c* being 603*b*, lower than 603*a*.

Thus, in the embodiment of FIG. 6, there is overheating at the beginning of the puff. This starts the aerosol generation earlier, which may give a better reactivity, that is to say, a shorter time to first puff, for the user. This may also avoid very large aerosol particles or very highly concentrated aerosol being generated at the start of the puff.

Various embodiments have been described with reference to FIGS. 2 to 6. The skilled person will appreciate, however, that any of the features of these embodiments may be combined. For example, the one threshold arrangement shown in FIG. 2 may be combined with the gradual power decrease shown in FIG. 5 and, additionally or alternatively, the overheat at the start of a puff shown in FIG. 6. Similarly, the two threshold arrangement of either FIG. 3 or FIG. 4 may be combined with the slow power decrease shown in FIG. 5 and, additionally or alternatively, the overheat at the start of a puff shown in FIG. 6.

The particular heating profile may be dependent on the puff profile for a particular user. The electric circuitry controlling supply of power to the heating element may be programmable. The electric circuitry may be user-programmable so that a user can select a desired heating profile depending on preferred aerosol characteristics. The electric circuitry may be intelligent, and able to automatically tailor the heating profile to the particular airflow profile, for example on a puff-by-puff basis.

Figure 7:
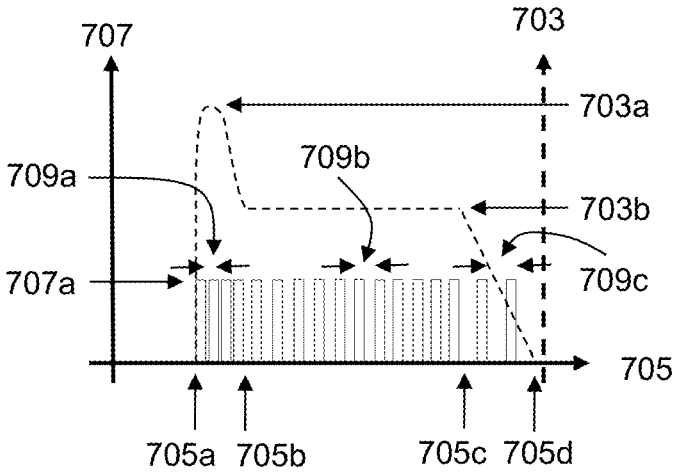
FIGS. 7 and 8 show how the heating power to a heating element of an electrically heated aerosol generating system may be controlled via a pulsed current signal.

FIG. 7 shows how the heating power to a heating element of an electrically heated aerosol generating system may be controlled via a pulsed current signal.

FIG. 7 is a plot showing heating power 703 and current intensity 707 on the vertical axis, and time 705 on the horizontal axis. In FIG. 7, heating power 703 is shown by a dotted line and current intensity 707 is shown with a solid line. The heating power, measured in Watts, is the power provided to the heating element from the power supply, under control of the electric circuitry such as hardware 109 in FIG. 1. The current intensity is the current, measured in Amperes, flowing through the heating element, under control of the electric circuitry such as hardware 109 in FIG. 1. FIG. 7 shows a single puff taken by a user on an electrically heated aerosol generating system, such as that shown in FIG. 1. Note that, in FIG. 7, however, the airflow rate is not shown.

The heating profile shown in FIG. 7 includes the overheat at the start of the puff, like that shown in FIG. 6. This is between times 705*a* and 705*b*. It also includes the gradual power decrease the end of the puff, like that shown in FIG. 5. This is between times 705*c* and 705*d*. Between times 705*b* and 705*c*, the power is maintained at a substantially constant level. However, the control shown in FIG. 7 may be used to provide any suitable heating profile.

In FIG. 7, when the puff detection system senses that the airflow rate (not shown) has increased to a first threshold, at time 705*a*, the electric circuitry controls the power to switch on the heating element and increase the heating power 703. The heating power 703 is increased to power 703*a*. The electric circuitry achieves this by providing a pulsed current signal through the heating element. In FIG. 7, each pulse has a maximum current 707*a* and the frequency of the current pulses between time 705*a* and 705*b* is 709*a*.

At time 705*b*, the electric circuitry controls the power to reduce the heating power to power 703*b* and from thereon, the heating power is maintained at power 703*b*. The electric circuitry achieves this by providing a pulsed current signal through the heating element. In FIG. 7, each pulse has a maximum current 707*a* and the frequency of the current pulses between time 705*b* and 705*c* is 709*b*, a lower frequency than frequency 709*a*.

When the puff detection system senses that the airflow rate (not shown) has decreased to a second threshold (which may be the same as or greater than the first threshold), at time 705*b*, the electric circuitry controls the power to gradually decrease the heating power 703. The heating power 703 is decreased gradually from power 703*b* at time 705*c* to zero at time 705*d*. The electric circuitry achieves this by providing a pulsed current signal through the heating element. In FIG. 7, each pulse has a maximum current 707*a* and the frequency of the current pulses between time 705*c* and 705*d* is 709*c*, a lower frequency than both 709*a* and 709*b*.

Figure 8:
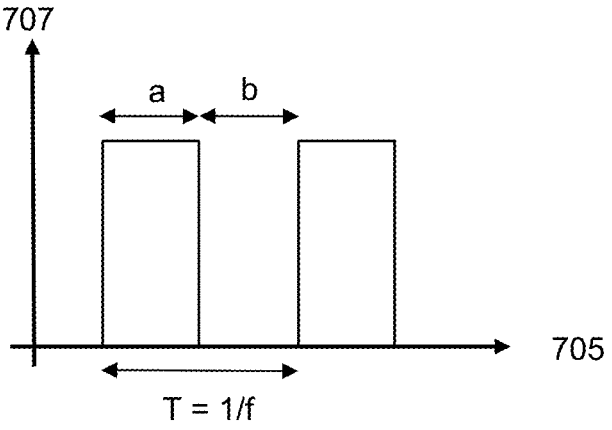

Thus, the electric circuitry controls the power provided to the heating element from the power supply by providing a pulsed current signal through the heating element. FIG. 8 further shows how the heating power to the heating element may be controlled via the pulsed current signal. FIG. 8 is a plot showing current intensity 707 on the vertical axis, and time 705 on the horizontal axis. FIG. 8 shows two current pulses in more detail.

In FIG. 8, the time during which the current signal is on is a. The time during which the current signal is off is b. The period of the pulsed current signal is T which is equal to 1/f, where f is the frequency of the pulsed current signal. The duty cycle (in %) of the pulsed current signal is equal to a/b×100.

The power provided to the heating element may be controlled by increasing or decreasing the frequency at a fixed duty cycle. In that case, the ratio of a:b remains constant, but the actual values of a and b vary. For example, a and b may be kept equal to one another (duty cycle=50%) with (a+b), and hence the frequency, varying.

Alternatively, the power provided to the heating element may be controlled by varying the duty cycle at a fixed frequency. In that case, the ratio of a:b changes, with (a+b), and hence the frequency, remaining fixed.

Alternatively, both the duty cycle and the frequency may be varied, although this may be more complicated to implement. FIG. 7, although rather schematic in nature, does show both the duty cycle and frequency varying. Referring to FIG. 7, between time 705*a* and time 705*b*, the frequency is 709*a*. It can be seen that the duty cycle is of the order of 95%. Between time 705*b* and time 705*c*, the frequency is 709*b*, which is lower than frequency 709*a*. In addition, it can be seen that the duty cycle is of the order of 50%. Between time 705*c* and 705*d*, the frequency is 709*c*, lower than frequencies 709*a* and 709*b*. It can also be seen that the duty cycle is of the order of 33%.

Thus, FIGS. 7 and 8 show that any particular heating profile may be established by the electric circuitry, by providing pulsed current signals through the heating element. The frequency or duty cycle or both frequency and duty cycle of the pulses will be appropriate to the heating power required during a particular time period and whether that heating power is required to remain constant, increase or decrease.

The method and electrically heated aerosol generating system according to the present invention provide a number of advantages. The heating profile may be tailored to the puff profile, thereby providing an improved experience for the user. The heating profile may also produce desired aerosol properties. The heating profile may also affect formation of condensed aerosol which, in turn, may affect liquid leakage. Power usage may be optimised, so as to provide a good heating profile, without unnecessary power wastage.

The invention claimed is:

1. A method for controlling at least one electric heating element of an electrically heated aerosol generating system for heating an aerosol-forming substrate, the electrically heated aerosol generating system having a sensor configured to detect airflow indicative of a user taking a puff having an airflow duration, the method being performed by electric circuitry and comprising:

increasing a heating power for the at least one heating element from zero to a power p1 when the sensor detects that an airflow rate has increased to a first threshold;

maintaining the heating power at the power p1 for at least some of the airflow duration; and decreasing the heating power for the at least one heating element from the power p1 to zero when the sensor detects that the airflow rate has decreased to a second threshold, wherein the first threshold is smaller than the second threshold.

2. The method according to claim 1, wherein the increasing the heating power for the at least one heating element from zero to the power p1 comprises increasing the heating power from zero to power p1 substantially instantly.

3. The method according to claim 1, wherein the decreasing the heating power for the at least one heating element from the power p1 to zero comprises decreasing the heating power from the power p1 to zero substantially instantly.

4. The method according to claim 1, wherein the decreasing the heating power for the at least one heating element from the power p1 to zero comprises decreasing the heating power from the power p1 to zero gradually.

5. The method according to claim 1, further comprising, after the increasing the heating power for the at least one heating element from zero to the power p1:

increasing the heating power for the at least one heating element from the power p1 to a power p2 greater than the power p1.

6. The method according to claim 1, wherein the maintaining the heating power at the power p1 for the at least some of the airflow duration comprises supplying pulses of electric current to the at least one heating element at a first frequency f1 and a first duty cycle.

7. The method according to claim 4, wherein the decreasing the heating power from the power p1 to zero further comprises gradually supplying pulses of electric current to the at least one heating element at a second frequency f2 and a second duty cycle.

8. The method according to claim 5, wherein the increasing the heating power for the at least one heating element from the power p1 to the power p2 greater than the power p1 further comprises supplying pulses of electric current to the at least one heating element at a third frequency f3 and a third duty cycle.

9. An electrically heated aerosol generating system for heating an aerosol-forming substrate, the electrically heated aerosol generating system comprising:

at least one electric heating element configured to heat the aerosol-forming substrate to form an aerosol;

a power supply configured to supply power to the at least one electric heating element; and electric circuitry configured to control a supply of power from the power supply to the at least one electric heating element, the electric circuitry including a sensor configured to detect airflow indicative of a user taking a puff having an airflow duration, wherein the electric circuitry is further configured to:

increase a heating power for the at least one heating element from zero to a power p1 when the sensor detects that an airflow rate has increased to a first threshold, maintain the heating power at the power p1 for at least some of the airflow duration, and decrease the heating power for the at least one heating element from the power p1 to zero when the sensor detects that the airflow rate has decreased to a second threshold, and wherein the first threshold is smaller than the second threshold.

10. The electrically heated aerosol generating system according to claim 9, wherein the aerosol-forming substrate is a liquid substrate, the system further comprising a capillary wick configured to convey the liquid substrate to the at least one electric heating element.

11. Electric circuitry for an electrically heated aerosol generating system, the electric circuitry being configured to perform a method for controlling at least one electric heating element of the electrically heated aerosol generating system for heating an aerosol-forming substrate, the electrically heated aerosol generating system having a sensor configured to detect airflow indicative of a user taking a puff having an airflow duration, the method comprising:

increasing a heating power for the at least one heating element, using the electric circuitry, from zero to a power p1 when the sensor detects that an airflow rate has increased to a first threshold;

maintaining the heating power, using the electric circuitry, at the power p1 for at least some of the airflow duration; and decreasing the heating power for the at least one heating element, using the electric circuitry, from the power p1 to zero when the sensor detects that the airflow rate has decreased to a second threshold, wherein the first threshold is smaller than the second threshold.

12. A nontransitory computer readable medium encoded with a computer program product, which when run on programmable electric circuitry for an electrically heated aerosol generating system, causes the programmable electric circuitry to perform a method for controlling at least one electric heating element of an electrically heated aerosol generating system for heating an aerosol-forming substrate, the electrically heated aerosol generating system having a sensor configured to detect airflow indicative of a user taking a puff having an airflow duration, the method comprising:

increasing a heating power for the at least one heating element, using the programmable electric circuitry, from zero to a power p1 when the sensor detects that an airflow rate has increased to a first threshold;

maintaining the heating power, using the programmable electric circuitry, at the power p1 for at least some of the airflow duration; and decreasing the heating power for the at least one heating element, using the programmable electric circuitry, from the power p1 to zero when the sensor detects that the airflow rate has decreased to a second threshold, wherein the first threshold is smaller than the second threshold.

* * * * *